United States Patent [19]

Moudgil et al.

[11] Patent Number: 4,814,069

[45] Date of Patent: Mar. 21, 1989

[54] METHOD OF BENEFICIATING PHOSPHATE ORES

[75] Inventors: Brij M. Moudgil; Dursun Ince, both of Gainesville, Fla.

[73] Assignee: University of Florida, Gainesville, Fla.

[21] Appl. No.: 147,307

[22] Filed: Jan. 22, 1988

Related U.S. Application Data

[63] Continuation of Ser. No. 833,070, Feb. 26, 1986, abandoned.

[51] Int. Cl.[4] ..... B03D 1/02; B03B 1/00; B03B 5/00

[52] U.S. Cl. ..... 209/17; 209/167

[58] Field of Search ..... 209/167, 166, 3, 17

[56] References Cited

U.S. PATENT DOCUMENTS 3,113,838 12/1963 Perri ..... 209/167 X 4,364,824 12/1982 Snow ..... 209/167

*Primary Examiner*—Kenneth M. Schor

*Attorney, Agent, or Firm*—Dennis P. Clarke

[57] ABSTRACT

The method of beneficiating a phosphate ore comprising apatite and including dolomitic impurities comprising reagentizing the ore having a particle size in the range of 75 μm to about 420 μm with an aqueous solution having a pH of from 3.5 to 4.5 and containing a fatty acid anionic collector and sodium chloride and subjecting the ore to froth flotation to float away the dolomitic impurities.

3 Claims, No Drawings

METHOD OF BENEFICIATING PHOSPHATE ORES

This is a continuation of application Ser. No. 833,070 filed Feb. 26, 1986 and now abandoned.

BACKGROUND OF THE INVENTION

1. Field of the Invention

The present invention relates to a method for beneficiating phosphate-bearing materials and is particularly directed to an improved method for separating dolomitic impurities from phosphate ores.

2. Prior Art

Phosphate bearing ores occur widely throughout the world, including central Florida, Idaho, Montana, Wyoming and Utah. All such ores contain impurities which must be removed in order to increase the phosphate content of the ore and to lessen the environmental impact thereof when used in fertilizer materials to enrich farmlands and increase crop yields and to enable the use thereof in the manufacture of phosphoric acid.

Most phosphate bearing ores particularly those found in central Florida and, most particularly, those found in the lower areas of such deposits contain alkaline earth metal carbonate mineral (i.e., dolomite) impurities. Dolomitic impurities are particularly disadvantageous in the manufacture of phosphoric acid since they contribute to substantial increases in the viscosity of the "green acid" prepared in the first stages of acid production.

A variety of flotation and heavy media separation techniques have been proposed in the past to separate dolomitic impurities from phosphate ores. Typical of such methods are those described in U.S. Pat. Nos. 2,293,640; 3,259,242; 3,462,016; 3,462,017; 3,807,556; 4,144,969; 4,189,103; 4,364,824 and 4,372,843.

In order to achieve sufficiently high concentration of phosphate fractions and to satisfactorily eliminate sufficient amounts of dolomitic impurities to enable the efficient use of such fractions in the preparation of phosphoric acid, it has been necessary in the past to employ expensive flotation reagents, multiple step procedures and elaborate systems, all of which contribute significantly to the overall cost of the prior art separation methods.

It is an object of the present invention to provide an improved method for beneficiating phosphate bearing ores containing dolomitic impurities.

SUMMARY OF THE INVENTION

The present invention provides a method of beneficiating phosphate ore comprising apatite and including dolomitic impurities, the method comprising the steps of (a) reagentizing a sample of the ore having a particle size in the range of from about 75 μm to about 420 μm with an aqueous solution having a pH of from about 3.5 to about 4.5 and containing from about 0.05% to about 0.2%, by weight, of anionic collector and from about 0.04% to about 0.12%, by weight, of a water-soluble monovalent or multivalent metal salt.

(b) subjecting the reagentized ore sample to flotation to float away said dolomitic impurities, and (c) recovering, as the sink fraction, an apatite concentrate.

Another embodiment of the present invention is a method of beneficiating a phosphate ore comprising an apatite fraction and including dolomitic impurities, the method comprising the steps of:

(a) reagentizing a sample of the ore having a particle size in the range of from about 75 μm to about 420 μm with an aqueous solution having a pH of from about 4 to about 7, and containing from about 0.05% to about 0.2%, by weight of cationic collector reagent and from about 0.04 to about 0.12%, by weight, of a water-soluble monovalent or multivalent metal salt.

(b) subjecting the reagentized ore sample to flotation to float said apatite fraction, and (c) recovering, as the float fraction, an apatite concentrate.

DETAILED DESCRIPTION OF THE INVENTION

As used herein:

(1) The term, "apatite", refers to sedimentary phosphate-containing mineral ores including the so-called "carbonate fluorapatites" and the "francolites" particularly those found in the lower regions of formations containing phosphate minerals from which the dolomitic impurities have not been leached out.

(2) The term, "dolomitic impurities" refers to those carbonate mineral impurities, particularly alkaline earth metal (i.e., Ca, Mg) carbonates, normally associated with apatites.

(b 3) The term, "reagentizing", refers to the step of slurrying an ore with an aqueous solution/dispersion of those reagents, i.e., collector, depressant, pH agent, etc., necessary to enable beneficiation of the ore by flotation. Generally, "reagentizing" is carried out in a conditioning zone or container wherein the ore and reagents containing aqueous solution are thoroughly admixed for a time sufficient for each reagent to contact eachparticle of ore and perform its intended function.

(4) The term, "flotation", refers to the well known and conventional procedure wherein the reagentized ore is conveyed to a flotation cell or system wherein an air wettable fraction is floated away as a "float fraction" and a water wettable fraction is recovered as a "sink fraction".

(5) The term, "anionic collector", refers to any anionic flotation agent which generally consists of a negatively charged polar head and a hydrocarbon chain "tail" which functions to aid ore flotation. Suitable such "anionic collectors" include long chain (i.e., 8 to 22 carbon atoms) saturated and unsaturated fatty acids, e.g., oleic and stearic acids, tall oil, sulfonated fatty acids and their salts, etc. The preferred anionic collectors for the method of the present invention are the fatty acids, in particular, the sodium salt of oleic acid.

(6) The term, "cationic collector", refers to any cationic flotation agent which generally consists of a positively charged polar head and a hydrocarbon chain "tail" and which functions to aid in ore flotation. Suitable such "cationic collectors" include the higher aliphatic amines, e.g., from about 10 to about 24 carbon atoms, and their salts with water-soluble acids; the esters of amino alcohols with high molecular weight fatty acids and their salts with water-soluble acids; the higher alkyl-O-substituted isoureas and their salts with water-soluble acids; the reaction product of polyalkylene polyamines with fatty acids or fatty acid triglycerides; the higher alkyl pyridinium salts of water-soluble acids; the higher quinolinium salts of water-soluble acids; rosin amines and their salts with water-soluble acids and the like.

The preferred cationic reagents are higher aliphatic amines or their acetate salts, e.g., amines having from about 6 to 20 carbon atoms, preferably about 8 to 18 carbon atoms or their acetate salts.

(7) The term, "sizing", refers to methods for producing or isolating ore samples having particles of a particular size range. The term includes methods of segregating ores into particular size fractions, e.g., screening, etc., and methods of reducing the particle size of ore samples, e.g., grinding, crushing, etc.

It will be understood by those skilled in the art that the methods of the present invention may be incorporated in any phosphate flotation procedure which also includes additional beneficiation steps such as washing, prior or subsequent flotation steps to remove other impurities, desliming, extraction, etc.

The present invention is predicated on the discovery that anionic and cationic flotation procedures and systems for the beneficiation of apatites are greatly facilitated and improved by the addition of certain monovalent and multivalent salts. Preferred are the chlorides and nitrates of calcium, magnesium, sodium, potassium, etc. Most preferred, however, is sodium chloride which exerts a much more beneficial effect on the flotation process than the other above-named salts.

The invention is further predicated on the discovery that it is critical to the success of the method of the invention that the concentrations of the various reagents in the reagentizing medium be maintained within certain narrow ranges.

Thus, the pH of the reagentizing medium must be maintained between about 3.5 and about 4.5 for the anionic flotation process and between about 4.0 and about 7.0 for the cationic flotation procedure. Any reagent capable of providing the requisite pH may be employed in the practice of the invention. It is only necessary to ensure that the reagent employed be one which does not deleteriously affect the flotation procedure or the desired apatite concentrate. Acids which may be employed to maintain the pH of the conditioning slurry in the desired range, include mineral acids and lower carboxylic acids, e.g., having from 1 to about 4 carbon atoms. Suitable acids include, for instance, acetic acid, phosphoric acid, hydrochloric acid, nitric acid, and sulfuric acid. Suitable bases include ammonia and inorganic hydroxides or carbonates such as sodium or potassium hydroxide or sodium or potassium carbonate. Preferred acids are sulfuric acid, acetic acid, phosphoric acid, nitric acid, and hydrochloric acid and the preferred bases are ammonia and potassium hydroxide.

Moreover, the anionic or cationic collector must be present in the flotation medium in an amount of from about 0.05% to about 0.2% of the weight of the ore.

Finally, the reagentizing medium must contain from about 0.04 to about 0.12%, by weight, based on the weight of the medium, of metal salt where the medium contains an anionic collector and from about 0.04 to about 0.12%, by weight, where the medium contains a cationic collector.

The apatite sample should preferably be sized to a particle size suitable for beneficiation by flotation. Generally, the ore sample should be sized to a size range from about 75 μm to about 420 μm, it being understood that the particle size of the ore sample is not overly critical to the success of the method of the invention.

It will be understood by those skilled in the art that the various reagents employed in the methods of the invention may be recovered from the various fractions and recycled.

The invention is illustrated by the following non-limiting examples. In each example, the same general procedure is followed, namely, suspension of the ore sample in, e.g., a sodium chloride solution at the appropriate pH followed by addition of the flotation collector and agitation of the reagentized sample by gentle tumbling for about 5 minutes. The reagentized suspension is then transferred to a flotation cell and flotation carried out until completion. The float and sink fractions are dried, weighed and analyzed for $P_2O_5$ and MgO content to determine separation efficiency.

EXAMPLE 1

A one gram sample of a 50:50 mixture of apatite and dolomite was reagentized for five minutes by tumbling at pH 4.05 with 107 ml of $3.5\times10^{-5}$ kmol/m$^3$ of sodium oleate prepared in $2\times10^{-2}$ kmol/m$^3$ of NaCl. The material was transferred into a Hallimond Flotation Cell and was floated for one minute. Dolomite particles reported in the float fraction and the apatite particles in the sink fraction. The float and sink fractions were dried and weighed. $P_2O_5$ and MgO content of the feed was 18.29% and 9.66%, respectively. The analysis of the float fraction product was 1.51% $P_2O_5$ and 19.56% MgO and that of the sink fraction was 33.30% $P_2O_5$ and 0.64% MgO. It was determined that 96.60% of dolomite in the feed was recovered in the float fraction and 95.97% of apatite was recovered in the sink fraction. These results indicate an excellent separation of dolomite from apatite.

EXAMPLE 2

The procedure of Example 1 was repeated. The $P_2O_5$ content of the feed was determined to be 17.84% and MgO content to be 9.66%. The analysis of the float fraction was 19.45% MgO and 1.85% $P_2O_5$. Recovery of the apatite in the sink fraction was found to be 94.27% and the dolomite in the float fraction was 97.65%. These results indicate an excellent separation of dolomite from apatite.

EXAMPLE 3

The procedure of Example 1 was repeated with a feed analyzing 9.12% MgO and 18.17% $P_2O_5$. The float fraction analyzed 19.64% MgO and 1.86% $P_2O_5$ and the sink fraction analyzed 0.48% MgO and 33.80% $P_2O_5$. Recovery of dolomite in the float fraction was 97.63% and that of apatite in the sink fraction was 94.75%, indicating an excellent separation of dolomite from apatite.

EXAMPLE 4

One gram of a 88:12 mixture of apatite and dolomite was conditioned at pH 6.3 for five minutes by tumbling with 107 ml of $5.6\times10^{-4}$ kmol/m$^3$ dodecylamine hydrochloride as collector, prepared in $2\times10^{-2}$ kmol/m$^3$ NaCl. The feed analysis was 31.54% $P_2O_5$ and 2.50% MgO. The float fraction analyzed 33.65% $P_2O_5$ and 0.97% MgO. Recovery of apatite in the float fraction (product) was 79.00%, indicating a very good separation of dolomite from apatite.

EXAMPLE 5

The procedure of Example 4 was repeated with a similar feed. The float fraction analyzed 33.49% $P_2O_5$ and 1.02% MgO. Recovery of apatite in the float fraction was 79.80% indicating a very good separation of dolomite from apatite.

EXAMPLE 6

The procedure of claim 4 was repeated. The float fraction analyzed 33.59% $P_2O_5$ and 1.03% MgO. Recovery of apatite in the float fraction was found to be 81.02% indicating a very good separation of dolomite from apatite.

While not wishing to be bound as to any theory of the mechanism of the invention, it is hypothesized that the sodium chloride functions as a depressant in the flotation procedure. At acidic pH's in the anionic flotation procedure, the sodium chloride functions as a phosphate depressant during flotation of the dolomitic impurities. It is not understood why sodium chloride functions unexpectedly and significantly better than other metallic salts, however.

At slightly acidic to neutral pH's during the cationic flotation procedure, the metal salt functions as a dolomite depressant during flotation of the apatite fraction.

It will be understood by those skilled in the art that the float and sink fractions of the various embodiments of the method of the invention may be recovered after completion of the flotation procedure according to any conventional technique, e.g., see any of the above cited patents, the disclosures of which, insofar as they relate to float and sink recovery techniques, are incorporated herein by reference.

We claim:

1. A method of beneficiating a phosphate ore comprising apatite and including dolomite impurities, said method consisting essentially of the steps of:

(a) reagentizing a sample of said ore having a particle size in the range of from about 75 μm to about 420 μm with an aqueous solution having a pH of from about 3.5 to 4.5 and containing from about 0.05% to about 0.2%, by weight, of a fatty acid anionic collector and from about 0.04 to about 0.12%, by weight of sodium chloride, (b) subjecting said reagentized ore sample to froth flotation to float away said dolomite impurities, and (c) recovering, as the sink fraction, an apatite concentrate.

2. The method of claim 1 including the step of washing and sizing said phosphate ore to said particle size prior to said reagentizing step.

3. The method of claim 1 including the step of recovering, as the float fraction, said dolomite impurities.

* * * * *